United States Patent [19]

Nakagomi

[11] Patent Number: 4,580,733

[45] Date of Patent: Apr. 8, 1986

[54] CRUSHING APPARATUS FOR SYNTHETIC RESIN MOLDED PRODUCTS

[76] Inventor: Shoji Nakagomi, 518-1, Shirakuwa, Urawa-shi, Saitama, Japan

[21] Appl. No.: 506,280

[22] Filed: Jun. 21, 1983

[30] Foreign Application Priority Data

Jun. 25, 1982 [JP] Japan ..... 57-95373

[51] Int. Cl.[4] ..... B02C 13/10

[52] U.S. Cl. ..... 241/163; 241/242; 241/260.1

[58] Field of Search ..... 241/152 A, 161, 162, 241/163, 242, 243, 260.1

[56] References Cited

U.S. PATENT DOCUMENTS 1,728,227 9/1929 Bunting ..... 241/243 X 4,344,580 8/1982 Hoshall et al. ..... 241/260.1 X

*Primary Examiner*—Howard N. Goldberg

*Assistant Examiner*—Timothy V. Eley

*Attorney, Agent, or Firm*—Jordan and Hamburg

[57] ABSTRACT

A crushing apparatus for crushing synthetic resin molded products as wastes into the form of pellets. This crushing apparatus comprises a housing formed at top with a hopper into which pieces of molded products are discharged and at bottom with a dropping opening through which finely crushed material drop, and a driving shaft rotatably mounted on the middle of said housing. On the driving shaft are mounted rotating blade for rough crushing for roughly crushing the pieces of molded products and rotating blades for fine crushing for finely crushing the same, said both rotating blades being coaxially mounted. The lower portion of the rotating blades for rough crushing is covered with a cover member so that roughly crushed pieces may be repeatedly crushed without dropping into the dropping opening. If the pieces of molded products charged through the hopper have their size caught by the rotating blades for fine crushing, they are crushed into the form of pellets by the rotating blades for fine crushing. Pieces not caught by the rotating blades for fine crushing having their size not caught by the rotating blades for fine crushing are crushed by the rotating blades for rough crushing into the size caught by the rotating blades for fine crushing.

4 Claims, 5 Drawing Figures

CRUSHING APPARATUS FOR SYNTHETIC RESIN MOLDED PRODUCTS

FIELD AND BACKGROUND OF THE INVENTION

The present invention relates to a crushing apparatus for crushing synthetic resin molded products, which became useless, into the form of pellets.

Where molded products formed of polyvinyl chloride resin, acrylic resin or polyethylene resin became useless, wastes therefrom have to be treated, which poses a great problem. Under these circumstances, it has been proposed to reuse these wastes as a part of raw material for new resin products. That is, resin molded products which became useless are crushed into pellets, and the thus crushed resins are mixed into virgin pellets to produce new resin products.

For such a crushing apparatus, there has been proposed, for example, an apparatus generally indicated at 11 in FIGS. 1 and 2. The crushing apparatus 11 comprises a crushing chamber 14 having a molded product hopper 12 at a top thereof and a crushed pellet dropping opening 13, and a driving chamber 16 for accommodating therein a motor 15. Within the crushing chamber 14, there are provided two driving shafts 17 and 18 spaced up and down, said upper driving shaft 17 having a plurality of rotating blades 19 used for rough crushing mounted thereon and said lower driving shaft 18 having a plurality of rotating blades 20 used for fine crushing mounted thereon. The driving shaft 17 is connected to a shaft 22 of the motor 15 through a coupler 21 and the driving shaft 18 is connected to the driving shaft 17 through gears 23, 24. Crushed pieces 25 of waste resin molded products roughly crushed by means of a press or the like are discharged through the hopper 12 and roughly crushed by the rotating blades 19 while being guided by a guide plate 26 and fixed comb blades 27 provided corresponding to the rotating blades 19, after which they drop onto the lower rotating blades 20. The roughly crushed pieces are finely crushed into pellets by means of the rotating blades 20 while being guided by a guide plate 28 and fixed comb blades 29 provided corresponding to the rotating blades 20, and the pellets 30 are fed outside the crushing apparatus 11 through the dropping opening 13. Since such a crushing apparatus is provided with the roughly crushing rotating blades and the finely crushing rotating blades spaced up and down, the construction of the whole crushing apparatus becomes large-sized. Furthermore, the conventional crushing apparatus need be provided with driving mechanisms for two rotating blades, and the driving mechanism is disadvantageously complicated.

SUMMARY OF THE INVENTION

It is an object of the present invention to provide a crushing apparatus for synthetic resin molded products which is simple in construction and can be made into a small-size.

In accordance with the present invention, there is provided a crushing apparatus for synthetic resin molded products, which comprises a housing formed at top with a hopper into which synthetic resin molded products are discharged and at bottom with a dropping opening through which crushed synthetic resin molded products drop, a driving shaft provided rotatably in the middle within the housing and which axis extends in a horizontal direction, a plurality of first rotating blades for rough crushing provided coaxially with and axially spaced from said driving shaft, a plurality of second rotating blades for fine crushing provided coaxially with the driving shaft spaced from the first-mentioned rotating blades, and a cover member which covers a portion of a dropping opening of the first rotating blades to prevent roughly crushed molded products from being dropped into the dropping opening.

In accordance with a preferred embodiment of the present invention, the first rotating blades has at least two crushing blades in cooperation with first fixed comb blades mounted on the housing corresponding to said first rotating blades, said crushing blades being spaced apart through 180°, and the second rotating blades has a number of saw-tooth crushing blades in cooperation with fixed comb blades mounted on the housing corresponding to said second rotating blades. The wall thickness of the first rotating blades is greater than that of the second rotating blades to scoop up molded products dropped into the cover member.

In the crushing apparatus for synthetic resin molded products in accordance with the present invention, if discharged molded products are so rough as not to be caught by the second rotating blades, these products are fed onto the first rotating blades while jumping on the second rotating blades, and they are roughly crushed by the first rotating blades, after which they are finly crushed by the second rotating blades, even rough products to be crushed can be finely crushed effectively. Moreover, in the crushing apparatus of the present invention, the rotating blades for rough crushing and rotating blades for fine crushing are provided coaxially with a single driving shaft, and therefore, the present crushing apparatus can be made smaller than the conventional crushing apparatus, and in addition, only one driving shaft may be rotated and hence, a driving system therefor can be simplified.

DESCRIPTION OF THE PREFERRED EMBODIMENT

Figure 3:
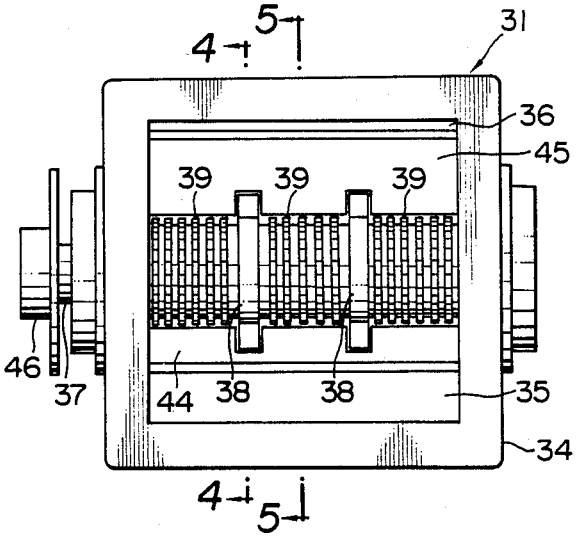
FIG. 3 is a plan view showing one embodiment of a crushing apparatus in accordance with the present invention.
Figure 2:
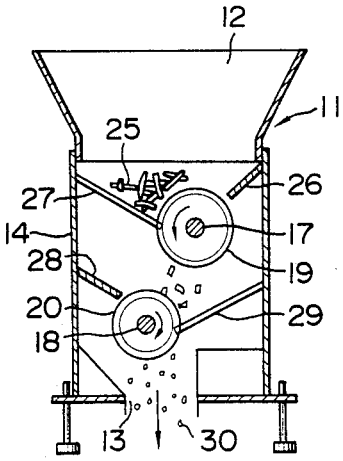
FIG. 2 PRIOR ART
FIG. 2 is a sectional view taken along line 2—2 of FIG. 1.
Figure 4:
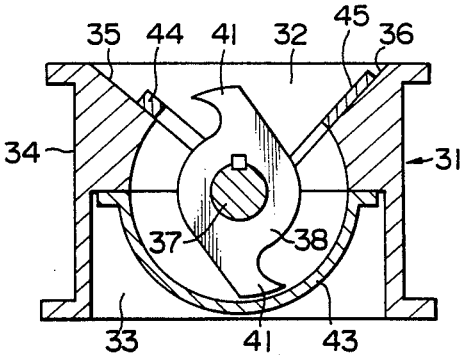
FIG. 4 is a sectional view taken along line 4—4 of FIG. 3.
Figure 5:
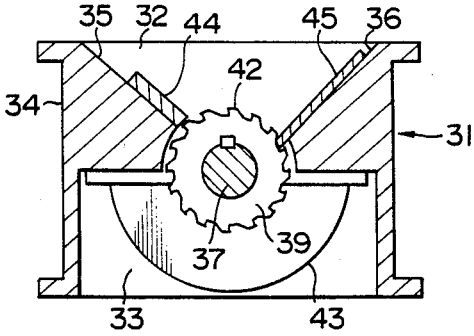
FIG. 5 is a sectional view taken on line 5—5 of FIG. 3.

Referring now to FIGS. 3 to 5, there is shown one embodiment of a crushing apparatus for synthetic resin molded products in accordance with the present invention, which is indicated generally at 31. The crushing apparatus has a housing 34 formed at top with a hopper 32 for molded products and at bottom with a dropping opening 33 for finely crushed molded products. The hopper 32 comprises inclined surfaces 35, 36 in which a pair of opposed surfaces are obliquely and downwardly inclined towards the central portion internally of the housing 34. The central portion internally of the housing 34 has a driving shaft 37 rotatably supported thereon. The driving shaft 37 has its axis which extends horizontally and perpendicularly to the inclined surfaces 35, 36. On the driving shaft 37 are mounted two rotating blades for rough crushing 38 in suitably spaced relation, a part of which extends into the hopper 32 and dropping opening 33. On the driving shaft 37 between these rotating blades 38 and between the side wall of the housing 34 and the rotating blades 38 are mounted a plurality of rotating blades 39 for fine crushing in a suitably spaced relation, a part of which extends into the hopper 32 and dropping opening 33. The rotating blades 38 for rough crushing 38 has two crushing blades 41 provided spaced apart through approximately 180°, and the wall thickness of the rotating blades 38 is greater than that of the rotating blades for fine crushing 39. The rotating blades for fine crushing 39 has a number of saw-tooth blades 42 in thier circumferential edge. A part of the rotating blades 38 for rough crushing 38 extending into the dropping opening 33 is covered with a cover member 43 so as not impair their rotation.

Figure 1:
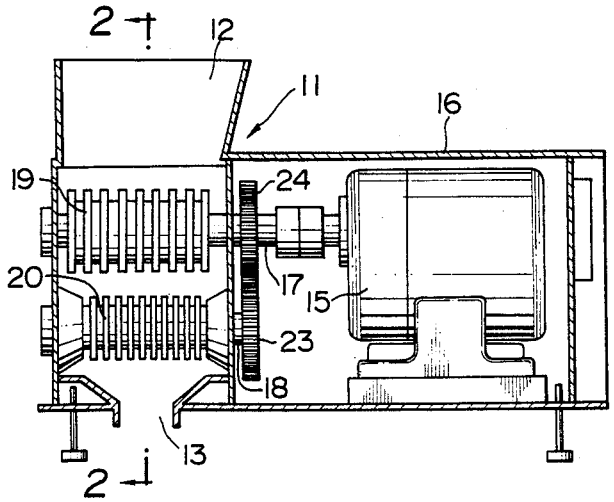
FIG. 1 PRIOR ART
FIG. 1 is a side sectional view showing one example of a conventional crushing apparatus.

The inclined surface 35 of the housing has fixed comb blades 44 corresponding to the rotating blades 38, 39 mounted thereon whereas the inclined surface 36 thereof has a receiving plate 45 mounted thereon to receive crushed pieces of charged molded products. While the upper ends of the fixed comb blades 44 and receiving plate 45 is lower than the upper end of the hopper 32, it should be noted that the first-mentioned upper end can be made to register with the upper end of the hopper 32. The upper half of the housing 34 is designed to cover the outer peripheries of the rotating blades for rough crushing 38 and rotating blades for fine crushing 39. The driving shafts 37 has one end extended outwardly from the side wall of the housing 34, said extended end being provided with a pulley 46. This pulley 46 is connected to an external power source through an endless belt though not shown. It will be of course noted that the rotating shaft of the motor can be directly connected to the driving shaft as shown in FIG. 1.

Resin molded products or pieces to be crushed are charged into the hopper and the driving shaft 37 is driven to rotate the rotating blades 38 for rough crushing and rotating blades 39 for fine crushing. If the resin molded products charged through the hopper 32 are relatively large in size, they are not well caught by the rotating blades 39 for fine crushing and jump thereon. This jumping of the products is effected while being moved to left and right due to the contact with other resin molded products, and the products are positioned on the rotating blades 38 for rough crushing due to said leftward and rightward movement and the products may be roughly crushed by the crushing blades 41 of the rotating blades 38. The crushed molded products are scooped up by the cover member 43 without dropping into the dropping opening 33, where they ae repeatedly crushed. When the products are more finely crushed, then they are further crushed by the rotating blades 39 for fine crushing into fine or pellet-like products which are then fed outside of the machine through the dropping opening.

As described above, in the crushing apparatus for synthetic resin molded products in accordance with the present invention, the crushing blades and blades for fine crushing are mounted on the same shaft, and the crushed pieces of the molded products having the size not caught by the blades for fine crushing are subjected to preliminary crushing by the blades for rough crushing, after which they are finely crushed into a predetermined size. Accordingly, even material to be crushed having a large grain size can be finely crushed effectively.

What is claimed is:

1. A crushing apparatus for synthetic resin molded products, comprising a housing formed at a top with a hopper into which said molded products are supplied and at a bottom with a dropping opening through which said molded products drop, a driving shaft provided rotatably within said housing and having an axis extending in a generally horizontal direction, said housing having end walls generally perpendicular to the axis of said shaft, a plurality of first axially spaced rotating blades mounted on said shaft for roughly crushing said molded products, a plurality of second rotating blades mounted on said shaft for finely crushing said products and dropping said crushed molded products into said dropping opening, some of said second rotating blades being mounted on said shaft between at least two of said spaced first rotating blades and other of said second rotating blades being mounted on said shaft between each of said end walls of said housing and said first rotating blades, said first rotating blades having a diameter greater than the diameter of said second rotating blades, and a plurality of cover members each underlying a lower portion of each of said first rotating blades so that as each of said first rotating blades roughly crushes said molded products, each of said cover members prevents the molded product which is being roughly cut from dropping into said dropping opening.

2. A crushing apparatus according to claim 1, wherein said hopper has hopper walls downwardly inclined from an upper end of said housing towards a central portion internally of said housing, said driving shaft extending in a direction generally parallel to said hopper walls, said hopper walls having fixed comb blades disposed about the outer radial portions of said first and second rotating blades.

3. A crushing apparatus according to claim 1, wherein said first rotating blades have an axial thickness greater than the axial thickness of said second rotating blades.

4. A crushing apparatus according to claim 1, wherein said first and second rotating blades each have a plurality of peripherally spaced blade elements on the outer periphery thereof, said second rotating blades each having a greater number of blade elements than said first rotating blades.

* * * * *